US005915732A

United States Patent [19]

Schaffnit

[11] Patent Number: 5,915,732

[45] Date of Patent: Jun. 29, 1999

[54] JAR TICKET PERFORATOR AND TICKET PRODUCED THEREBY

[75] Inventor: Jim Andrew Schaffnit, Cleveland, Ohio

[73] Assignee: Arrow International, Inc., Cleveland, Ohio

[21] Appl. No.: 08/847,103

[22] Filed: May 1, 1997

Related U.S. Application Data

[60] Provisional application No. 60/016,916, May 6, 1996.

[51] Int. Cl.[6] ..... B42D 15/00

[52] U.S. Cl. ..... 283/106; 285/105; 285/81

[58] Field of Search ..... 283/72, 101, 105, 283/103, 106, 81, 903

[56] References Cited

U.S. PATENT DOCUMENTS

| | | | |
|---|---|---|---|
| 3,900,219 | 8/1975 | D'Amato et al. . | |
| 4,299,637 | 11/1981 | Oberdeck et al. | 156/64 |
| 4,513,993 | 4/1985 | Brown | 283/103 |
| 4,703,933 | 11/1987 | Cahill et al. | 283/103 |
| 5,174,609 | 12/1992 | Tucker | 283/903 X |
| 5,217,258 | 6/1993 | Sanderson | 283/105 |
| 5,253,899 | 10/1993 | Greenwood | 283/106 |
| 5,286,062 | 2/1994 | Greenwood et al. | 283/106 |
| 5,403,636 | 4/1995 | Crum | 283/105 X |
| 5,529,208 | 6/1996 | Carstens et al. | 221/155 |
| 5,562,284 | 10/1996 | Stevens | 283/903 |
| 5,658,015 | 8/1997 | Allegre | 283/81 X |
| 5,676,401 | 10/1997 | Witkowski et al. | 283/81 |

*Primary Examiner*—Willmon Fridie, Jr.

*Attorney, Agent, or Firm*—Fay, Sharpe, Beall, Fagan Minnich & McKee

[57] ABSTRACT

A jar ticket includes a ticket body having first, second and third panels wherein the third panel is folded onto the second panel and the second panel is then folded onto the first panel to constitute a folded section of the ticket body. A wrapper body is then folded around the ticket body folded section. The wrapper body includes first, second and third panels. The second panel of the wrapper body is brought adjacent a first side of the folded section of the ticket body and the first and third panels of the wrapper body are folded over a second side of the folded section of the ticket body. A first layer of adhesive is disposed between the first and third panels of the wrapper body and a plurality of spaced perforations extend through the first and third panels of the wrapper body. Such a jar ticket has enhanced security. A jar ticket manufacturing machine for such a jar ticket is also disclosed.

18 Claims, 6 Drawing Sheets

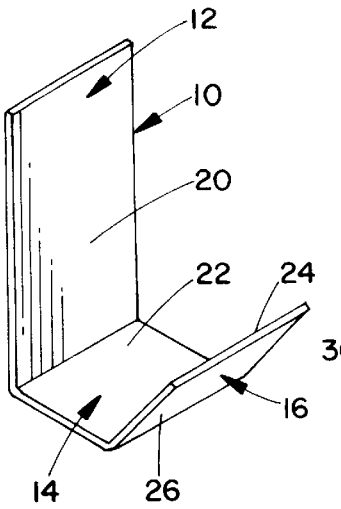
FIG. 1A
(PRIOR ART)
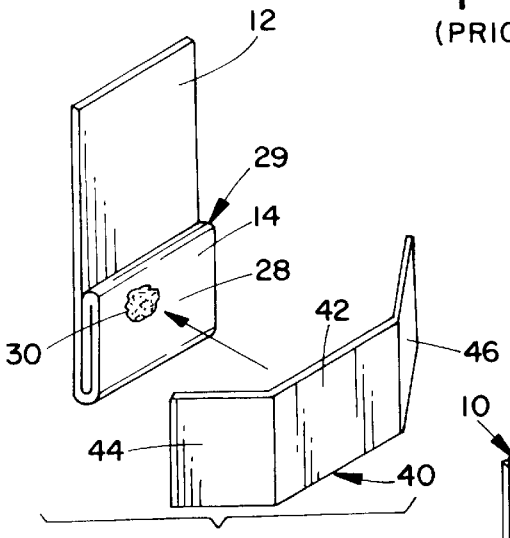
FIG. 1B
(PRIOR ART)
FIG. 1C
(PRIOR ART)
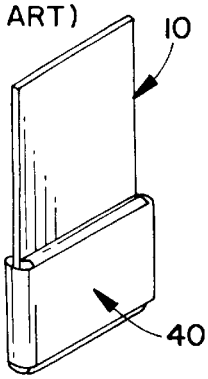
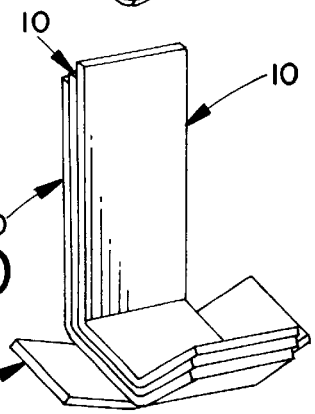
FIG. 1D
(PRIOR ART)
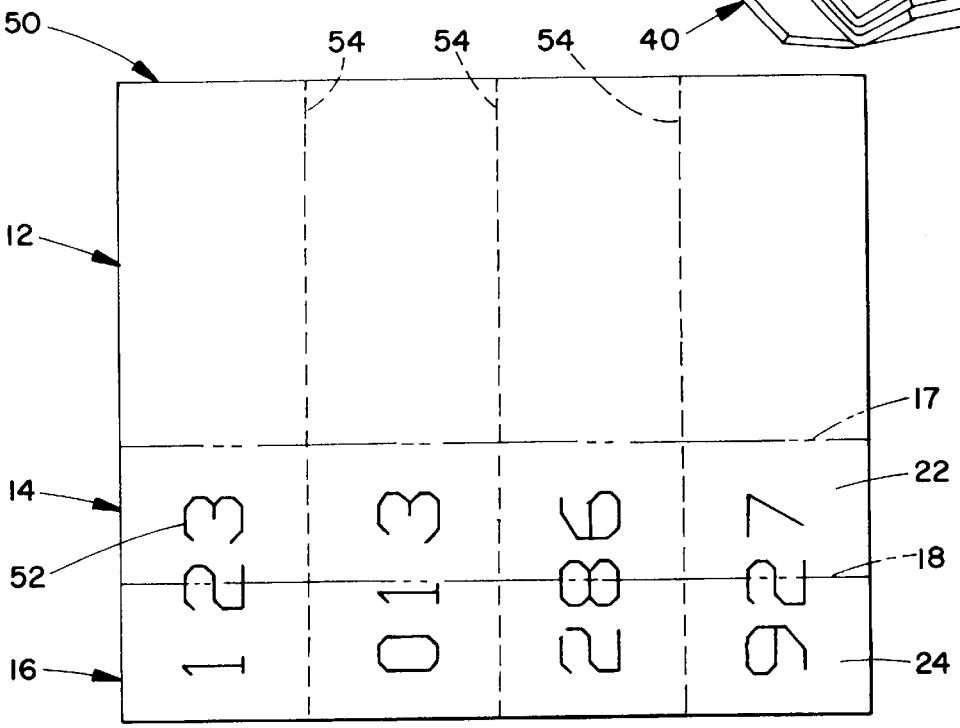
FIG. 2
(PRIOR ART)

JAR TICKET PERFORATOR AND TICKET PRODUCED THEREBY

This application claims benefit of Provisional Appl. No. 60/016,916, filed May 6, 1996.

BACKGROUND OF THE INVENTION

This invention pertains generally to gaming tickets. More particularly, the present invention concerns a gaming ticket with improved security features and an apparatus for manufacturing same.

One well known type of gaming ticket is a jar ticket. A standard jar ticket is a small paper charitable gaming ticket which has numbers or symbols printed on one side of the ticket, when it is open, to indicate if the ticket is a winner or a loser. The tickets are folded in order to hide the numbers or symbols printed thereon. The folded tickets are then wrapped with a colored paper band which is glued to the ticket in order to further hide the printed numbers or symbols from both the buyer and the seller.

It has been found, however, that the security features of conventional jar tickets can be defeated. In other words, the colored paper band which is wrapped around the jar ticket and glued to it can be removed and the ticket can be unfolded to see whether it is a winner or loser. An unscrupulous person can then reattach the colored paper band—so that no one will know that the ticket has been tampered with—and sell the ticket.

Accordingly, it has been considered desirable to develop a new and improved jar ticket and a method and apparatus for manufacturing same which would provide improved security features for the jar ticket.

BRIEF SUMMARY OF THE INVENTION

In one embodiment of the present invention, a new and improved jar ticket is provided.

More particularly in accordance with this embodiment of the invention, the jar ticket includes a ticket body comprising a first panel, a second panel located adjacent to the first panel and connected thereto and a third panel located adjacent the second panel and connected thereto. The third panel is folded onto the second panel and the second panel is then folded onto the first panel to comprise a folded section of the ticket body. A wrapper body is provided which is folded around the folded section of the ticket body. The wrapper body comprises a first panel, a second panel located adjacent the first panel and connected thereto and a third panel located adjacent the second panel and connected thereto. The first and third panels are folded in relation to the second panel such that the second panel is brought adjacent a first side of the folded section of the ticket body and the first and third panels are folded over a second side of the ticket body. A layer of adhesive is disposed between the three panels of the wrapper body and their mating surfaces. A plurality of spaced perforations extend through the first and third panels of the wrapper body. Jar tickets may be assembled with one wrapper body securing one ticket body or with one wrapper body securing multiple ticket bodies. In the case of multiple ticket bodies with one wrapper body, the ticket bodies are layered such that the first, second and third panels of each ticket body are adjacent to the first, second and third panels, respectively, of each succeeding ticket body.

In accordance with another aspect of the present invention, a method is provided for enhancing the security of a jar ticket.

More particularly in accordance with this aspect of the invention, the method comprises the steps of folding a ticket body so as to hide the indicia printed thereon. A wrapper body is then folded around the ticket body. A layer of adhesive is spread between a pair of overlying panels of the wrapper body. Subsequently, the pair of panels of the wrapper body are perforated.

In accordance with still another aspect of the present invention, a jar ticket manufacturing machine is provided.

In accordance with this aspect of the invention, the jar ticket manufacturing machine comprises a housing, a first shaft mounted on the housing and having a rotational axis and a second shaft mounted on the housing and positioned adjacent the first shaft. The second shaft has a rotational axis which is substantially parallel to the rotational axis of the first shaft. A driving mechanism is mounted on the housing for driving the first and second shafts. A first perforating knife is mounted on one of the first and second shafts and a feeding mechanism is mounted on the housing for feeding a jar ticket to the perforating knife.

To increase the security of a jar ticket, a series of perforations is added to the ticket. The perforations pierce from the side of the ticket on which the ends of the colored paper band overlap. The perforations are added after the ticket is completely folded and glued but while the glue is still wet. Glue is forced into the perforations. The combination of the perforations in the colored paper band and the increased penetration of the glue causes the colored paper band to tear if an attempt is made to peel back the paper band in order to look inside the ticket. The torn paper band serves as evidence that a ticket has been tampered with if an attempt is made to identify winning tickets before they are sold to the final buyer.

One advantage of the present invention is the provision of a new and improved jar ticket which has an enhanced security feature that makes it more difficult to peel back a paper band around the jar ticket and then reattach it.

Another advantage of the present invention is the provision of a method for perforating jar tickets after they are completely folded and glued, but while the glue is still wet, in order to enhance the security features of the jar ticket.

Still another advantage of the present invention is the provision of a jar ticket perforator assembly which is mounted at the end of a conventional jar ticket manufacturing machine.

A still further advantage of the present invention is the provision of a jar ticket perforator assembly in which the depth of perforation of perforator knives into the finished jar ticket can be controlled.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangements of parts, several preferred embodiments of which will be described in detail in this specification and illustrated in the accompanying drawings which form a part hereof and wherein:

FIG. 1A is a perspective view of a ticket body of a jar ticket according to the prior art in a partially unfolded position;

FIG. 1B is an exploded perspective view of the ticket body in a folded condition with a cover band shown in a partially folded condition adjacent thereto;

FIG. 1C is a completely folded jar ticket according to the prior art;

FIG. 1D is a perspective view of multiple ticket bodies and one cover band according to prior art in a partially unfolded position;

FIG. 2 is a top plan view of a prior art sheet having four jar tickets printed on it before the sheet is cut;

DETAILED DESCRIPTION OF THE PREFERRED EMBODIMENTS

Figure 3:
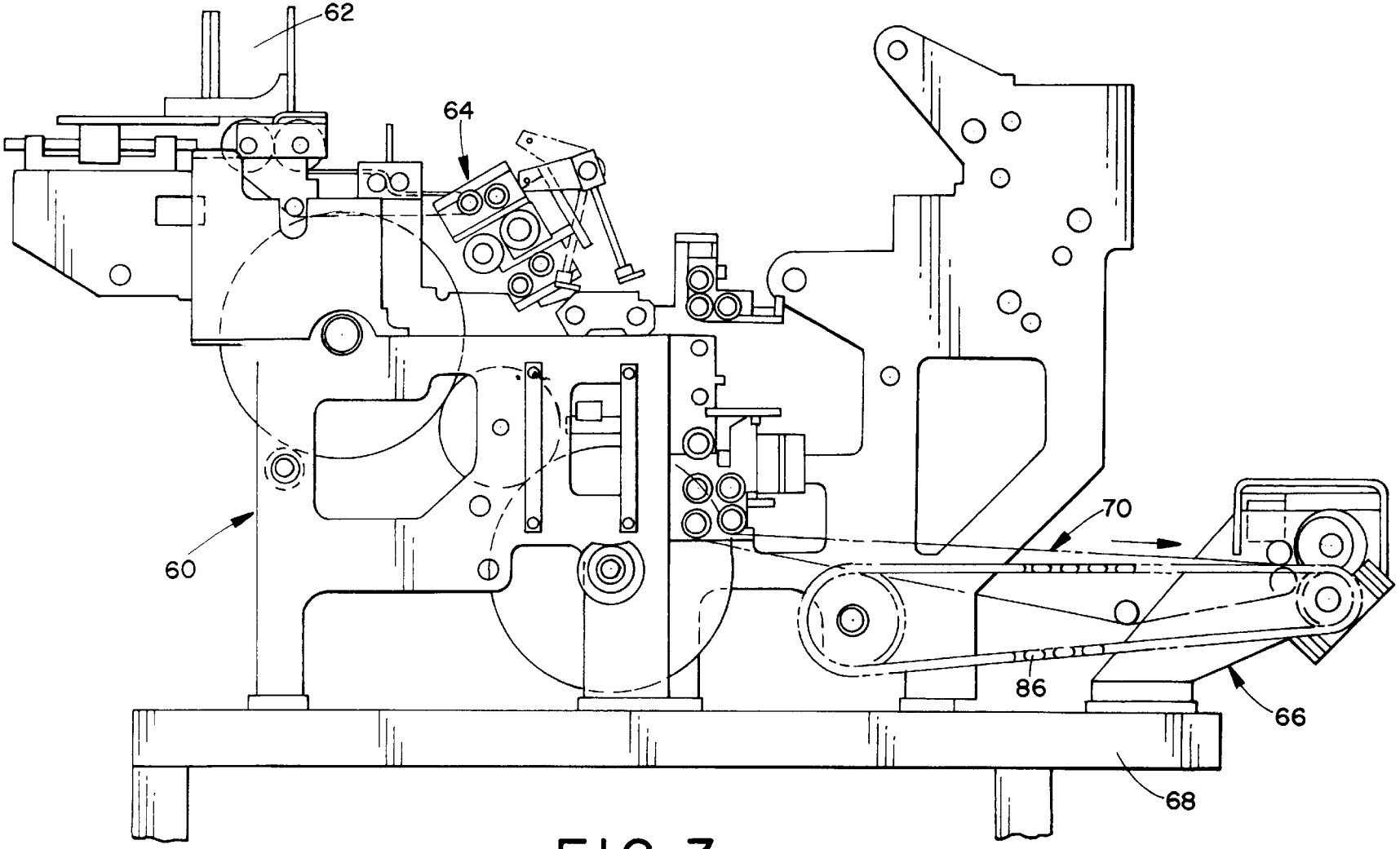
FIG. 3 is a schematic side elevational view of a jar ticket manufacturing machine according to the present invention.

Referring now to the drawings wherein the showings are for purposes of illustrating several preferred embodiments of the invention only and not for purposes of limiting same, FIGS. 1A–1C show a prior art jar ticket in the process of being manufactured. The jar ticket includes a ticket body 10 comprising a first panel 12, a second panel 14 and a third panel 16. As shown in FIG. 2, a first fold line 17 separates the first panel 12 from the second panel 14 and a second fold line 18 separates the second panel from the third panel 16.

The first panel 12 includes a first face 20. Located adjacent thereto is a first face 22 of the second panel 14 and a first face 24 of the third panel 16. The jar ticket is folded so that the third panel 16 is folded, around fold line 18, down against the second panel 14 which is then folded, around fold line 17, over onto the first panel 12. More specifically, it can be seen that the first face 24 of the third panel 16 covers the first face 22 of the second panel 14 and that a second face 26 of the third panel 16 is brought adjacent the first face 20 of the first panel 12. Thus a folded section 29 is formed in the ticket body. As shown in FIG. 1B, a second face 28 of the second panel 14 is then exposed and faces in the same direction as the first face 20 of the first panel 12.

A cover band 40 is then folded around the ticket body 10. The cover band includes a first or central panel 42 which is aligned with and glued to the exposed face 28 of the ticket body second panel 14 as is illustrated in FIG. 1B. The cover band also includes a second panel 44 and a third panel 46. These two panels are folded over onto the back side of the ticket body first panel 12 so that they overlie each other and are glued to each other by a suitable adhesive layer (not visible). Another layer of adhesive secures the inner one of these panels to the underlying ticket body panel.

In the case of multiple ticket bodies 10 secured by a single cover band 40, as shown in FIG. 1D, the tickets are folded such than on the first ticket body, the first face 24 of the third panel 16 is adjacent to the first face 22 of the second panel 14. Each succeeding ticket body is folded such that the first face 24 of the third panel 16 is adjacent to the second face 26 of the third panel 16 of the preceding ticket body 10 and the first face 22 of the second panel 14 is adjacent to the second face 28 of the second panel 14 of the preceding ticket body 10. The second face 26 of the third panel 16 of the last ticket body is folded so that it is adjacent to the first face 20 of the first panel 12 of the first ticket body. The second face 28 of the second panel 14 of the last ticket is then exposed and faces the same direction as the first face 20 of the first panel 12. An adhesive layer 30 can be coated on the exposed face 28.

With reference again to FIG. 2, one process for manufacturing jar tickets is such that four jar tickets are printed side-by-side on a sheet of paper 50. Once the indicia 52—which can be letters, numbers or graphical symbols—are printed on the sheet at the appropriate locations, the sheet 50 can be slit via slit lines 54 so as to form four separate jar tickets. As can be seen, the indicia 52 are printed on the first faces 22 and 24 of the second and third panels 14 and 16 of each ticket body. The folded section 29 covers up the indicia until the ticket body is unfolded.

With reference now to FIG. 3, a manufacturing machine 60 for jar tickets according to the present invention is there illustrated. After printing, the tickets are cut and stacked with four jar tickets per sheet 50. Each stack is then processed by being placed in a hopper 62 from which the bottom sheet is fed into a folding mechanism 64 which folds the second and third panels onto the first panel to conceal the game numbers or symbols. Next, the sheet is slit along slit lines into four separate tickets which are separated sideways. Then the cover band is glued and wrapped around the folded portion of the jar tickets. The completed tickets previously were simply dropped onto a conveyor means and delivered to a collection area for packaging. However, according to the present invention, a perforator mechanism 66 is secured to a base 68 of the machine 60 at the end of the conveyor means.

Figure 4A:
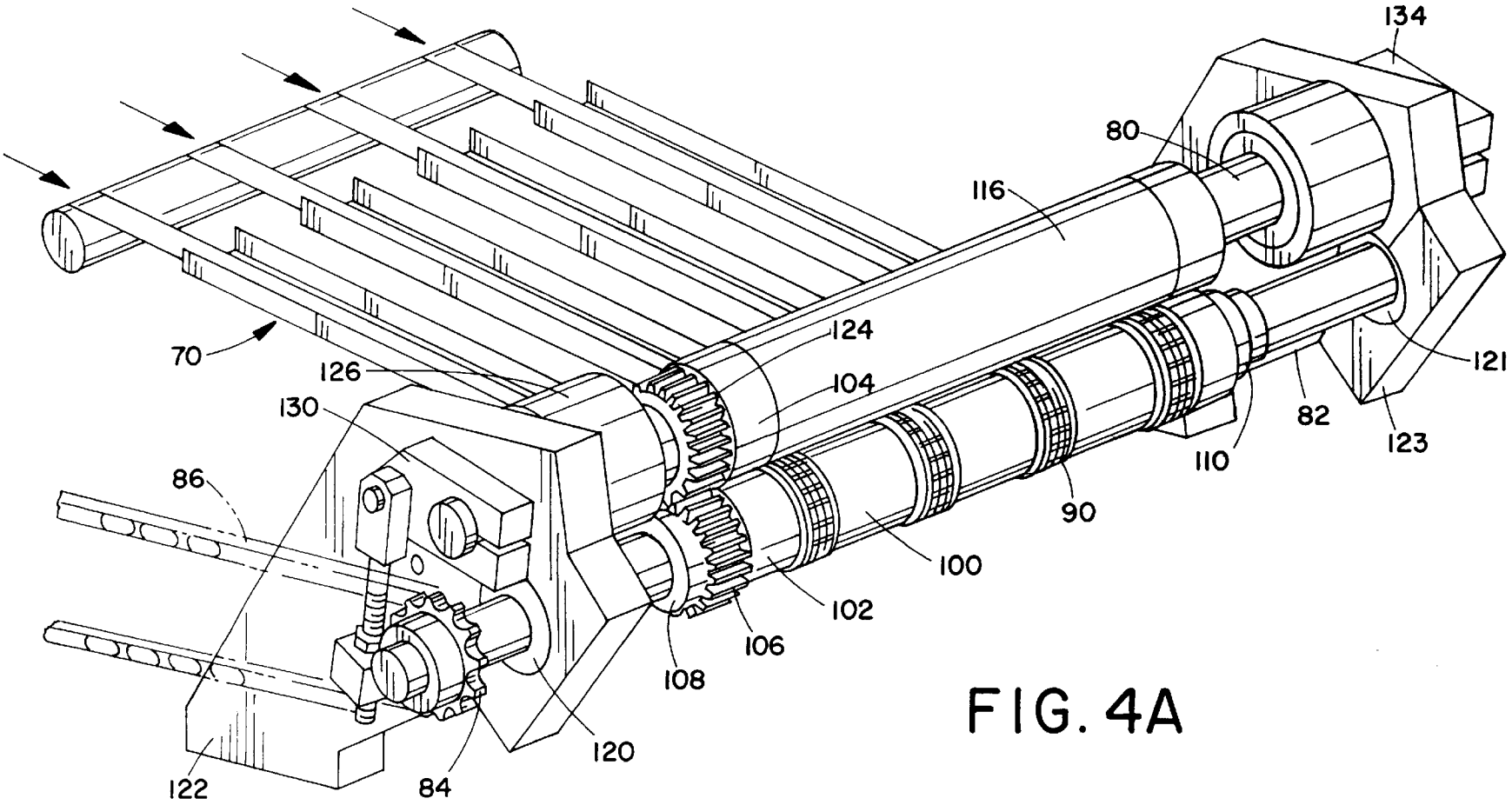
FIG. 4A is an enlarged perspective view of a perforating assembly of the machine of FIG. 3.

With reference now to FIG. 4A, the jar ticket perforator mechanism 66 is mounted at the end of a delivery conveyor 70 of the jar ticket machine. The assembly comprises a first shaft 80 and a second shaft 82 which are mounted parallel to each other. The jar tickets pass between these two shafts and are perforated. The second shaft 82 is driven by a sprocket 84 mounted adjacent one end of the second shaft via a conventional chain 86.

Figure 5:
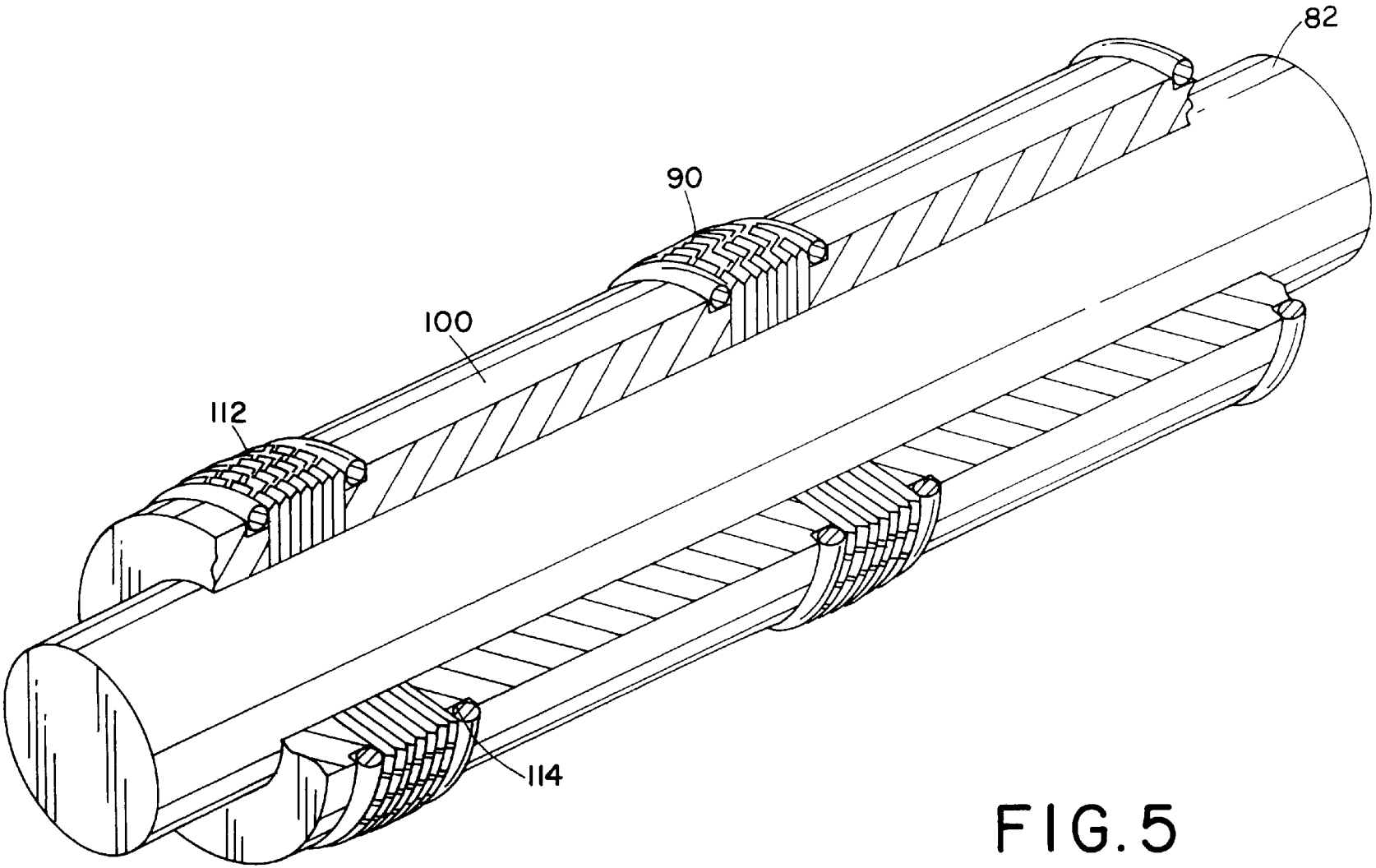
FIG. 5 is an enlarged perspective view, partially cut away, of a portion of the perforating assembly of FIG. 4A.
Figures 6A, 6B, 6C:
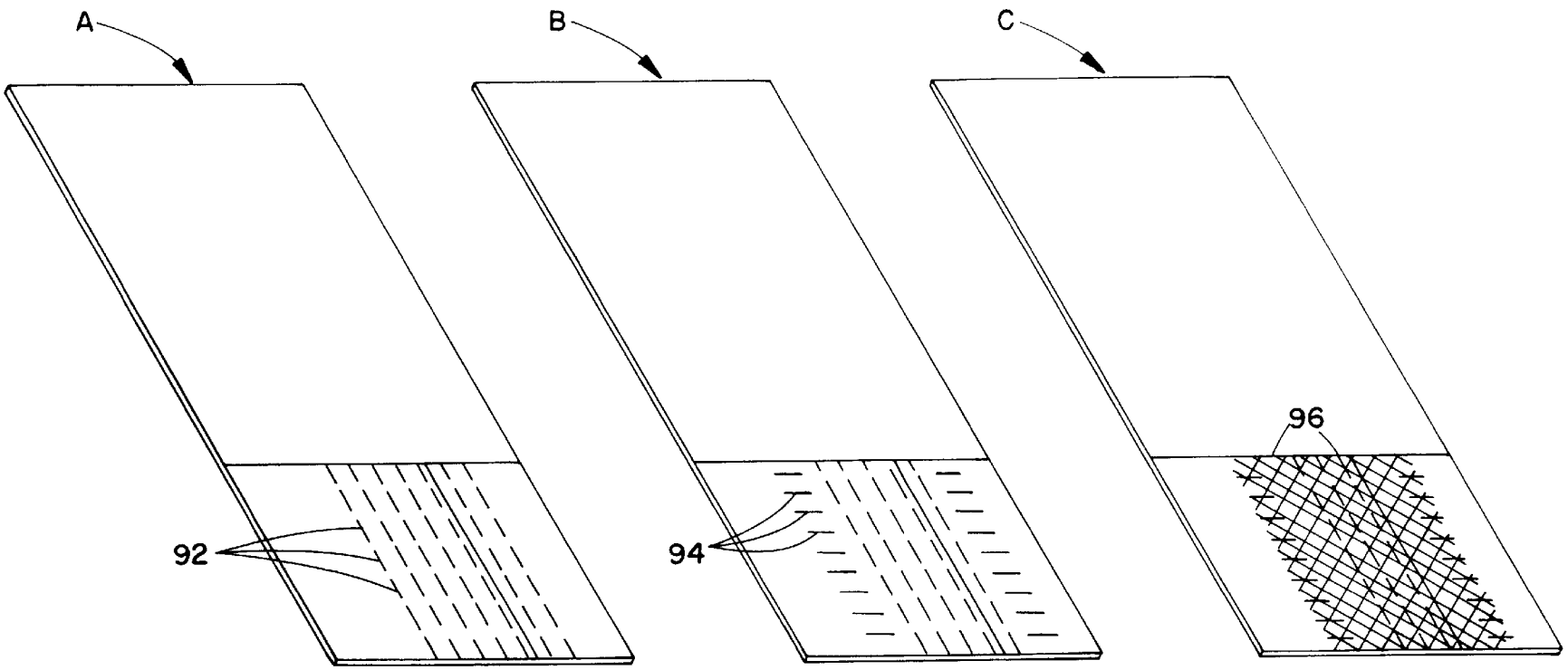
FIG. 6A is a schematic perspective view of a jar ticket according to a first embodiment of the present invention.
FIG. 6B is a schematic perspective view of a jar ticket according to a second preferred embodiment of the present invention; and, FIG. 6C is a schematic perspective view of a jar ticket according to a third preferred embodiment of the present invention.

With reference now also to FIG. 5, mounted on and concentric with the second shaft 82 are several groups of rotary perforating knives 90. Each group of knives 90 includes several knives which are located in a side-by-side manner. Four sets of perforating knives are shown, one set for each of four spaced jar tickets delivered by the conveyor 70. The perforating knives 90 each have a triangular tip profile as is evident from FIG. 5. The knives are interchangeable and may produce perforations which are oriented with, perpendicular to or are diagonal to the longitudinal axis of the ticket body. More specifically, FIG. 6A illustrates a jar ticket A with perforations 92 which are oriented parallel to the longitudinal axis of the jar ticket. In contrast, FIG. 6B illustrates perforations 94 which are perpendicular to the longitudinal axis of a jar ticket B. FIG. 6C illustrates perforations 96 which are diagonal to the longitudinal axis of a jar ticket C. As is illustrated in FIGS. 6B and 6C, a ticket may be produced with any combination of these perforation orientations.

With reference again to FIG. 4A, the sets of perforating knives 90 are positioned axially along the shaft 82 and are spaced from each other by spacer rings 100. Bearer rings 102 are positioned axially outward from the end sets of perforating knives 90. The bearer rings 102 on the second shaft 82 run against similar rings 104 on the first shaft 80. Located axially outwardly from one of the bearer rings on the second shaft 82 is a drive gear 106. The drive gear rests against a first clamp collar 108. The knives 90, spacers 100, bearer rings 102 and drive gear 106 are captured between the first clamp collar 108 and an internally threaded second clamp collar 110 that is threaded onto another end of the shaft 82 and clamped tight.

Elastomeric rings 112 (FIG. 5) are installed in undercut recesses 114 of the spacer rings 100 in order to increase the friction between the tickets and the rotating shaft assemblies thereby stabilizing each ticket during perforation. More specifically, a cylinder 116 is mounted on the first shaft 80 and rotates adjacent the knives 90 and spacers 100. It is evident from FIG. 4A that four spaced jar tickets can be perforated by the four spaced groups of perforating knives 90 in the perforator mechanism 66.

The second shaft 82 rotates in bearings 120, 121 which are housed in two side subframes 122, 123. The subframes are bolted to the base 68 of the machine 60. The first shaft 80 is similarly mounted on bearings.

The cylinder 116 of the first shaft 80 serves as an anvil supporting the tickets and allowing the perforator knives 90 on the second shaft 82 to penetrate completely through the cover band and partially through one layer or panel of the ticket body. The first shaft 80 is driven by a gear 124 which meshes with the gear 106 on the second shaft 82. The first shaft 80 rotates in ball bearings mounted in eccentric bearing housings 126 that are seated in bores of the subframes 122, 123.

Figure 4B:
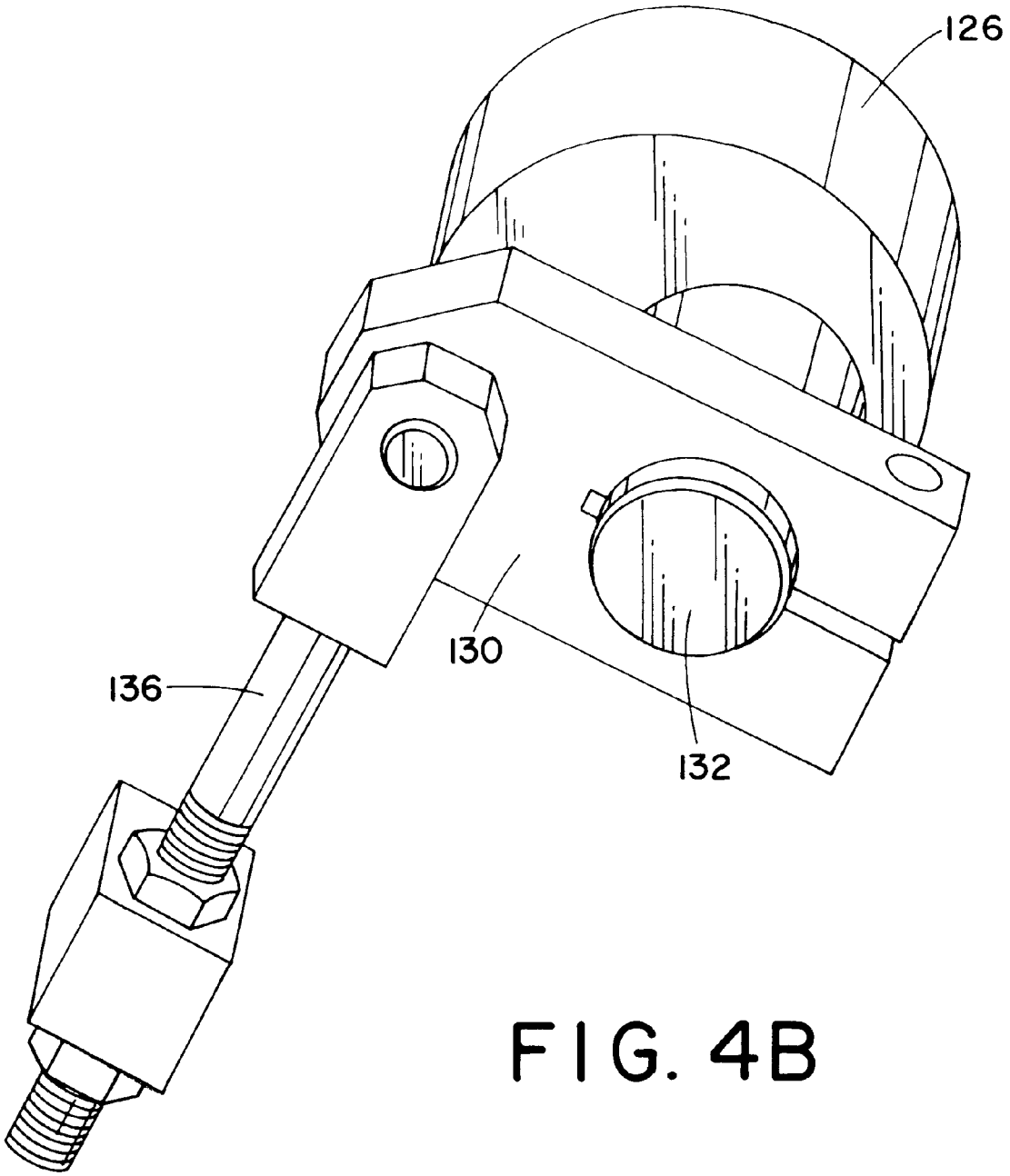
FIG. 4B is an enlarged perspective view of a portion of the perforating assembly of FIG. 4A.

Depth of perforation is dependent on the rotational position of the eccentric bearing housing 126 relative to a line between a pivot center of the bearing housing and a pivot center of the second shaft 82. With reference now also to FIG. 4B, an arm 130 is mounted to a center stud 132 of the eccentric bearing housing 126 immediately outboard of the subframe. It should be appreciated that the other end of the first shaft 80 is supported by an identical arm 134. An adjustable length linkage 136 is secured to one end of each of these arms 130, 134 and secured to a respective subframe 122, 123 on the other end. Changing the length of the linkage 136, rotates the eccentric bearing housing 126 changing the distance between the pivot centers of the first and second shafts 80 and 82, thus changing the distance between the bearing housings and, consequently, the depth of perforation of the knives 90 into the jar tickets.

The invention has been described with reference to several preferred embodiments. Obviously, alterations and modifications will occur to others upon a reading and understanding of this specification. It is intended to include all such modifications and alterations insofar as they come within the scope of the appended claims or the equivalents thereof.

What is claimed:

1. A jar ticket comprising:

at least one ticket body, comprising:

a first panel, a second panel located adjacent said first panel and connected thereto, and a third panel located adjacent said second panel and connected thereto, said third panel being folded onto said second panel and said second panel then being folded onto said first panel to comprise a folded section of said ticket body;

a wrapper body which is folded around said folded section of said ticket body, said wrapper body comprising:

a first panel, a second panel located adjacent said first panel and connected thereto, and a third panel located adjacent said second panel and connected thereto, said first and third panels being folded in relation to said second panel such that said second panel is brought adjacent a first side of said folded section of said ticket body and said first and third panels are folded over a second side of said folded section of said ticket body;

a first layer of adhesive disposed between said first and third panels of said wrapper body; and, a plurality of spaced perforations extending through said first and third panels of said wrapper body.

2. The jar ticket of claim 1 wherein said plurality of perforations extends into said folded section of said ticket body.

3. The jar ticket of claim 1 wherein at least some said plurality of perforations are parallel to a longitudinal axis of said ticket body.

4. The jar ticket of claim 1 wherein at least some of said plurality of perforations are perpendicular to a longitudinal axis of said ticket body.

5. The jar ticket of claim 1 wherein at least some of said plurality of perforations are disposed at an acute angle in relation to a longitudinal axis of said ticket body.

6. The jar ticket of claim 1 wherein multiple ticket bodies are layered in identical orientation and folded together with said first, second and third panels of each ticket body being located adjacent to a respective first, second and third panel of each succeeding said ticket body, and wherein a third panel of a last of said ticket bodies is located adjacent to the said first panel of a first ticket body.

7. The jar ticket of claim 1 further comprising a second layer of adhesive disposed between said second panel of said wrapper body and an adjacent panel of said ticket body.

8. A method for enhancing the security of a jar ticket comprising the steps of:

folding a ticket body so as to hide indicia printed thereon;

folding a wrapper body around said ticket body;

spreading a layer of adhesive between a pair of overlying panels of said wrapper body between the panels of the said wrapper body and the said ticket body; and, perforating said pair of panels of said wrapper body.

9. The method of claim 8 further comprising the step of partially perforating a panel of said ticket body.

10. The method of claim 8 further comprising the step of flowing the adhesive into the perforations formed during said step of perforating.

11. The method of claim 8 further comprising the step of adhering said pair of panels of said wrapper body to each other, said step of adhering occurring before said step of perforating.

12. A jar ticket comprising:

a ticket body comprising:

a first panel, a second panel located adjacent said first panel and connected thereto, and a third panel located adjacent said second panel and connected thereto, said third panel being folded onto said second panel and said second panel being folded onto said first panel to comprise a folded section of said ticket body;

a wrapper body for said ticket body, said wrapper body comprising:

a first panel, a second panel located adjacent said first panel and connected thereto, and a third panel located adjacent said second panel and connected thereto, wherein said first and third panels are folded in relation to said second panel such that when said second panel is brought adjacent a first side of said folded section of said ticket body and said first and third panels are folded over a second side of said folded section of said ticket body;

a first layer of adhesive disposed between said first and third panels of said wrapper body; and, at least one perforation extending through said first and third panels of said wrapper body.

13. The jar ticket of claim 12 wherein said at least one perforation extends into said folded section of said ticket body.

14. The jar ticket of claim 12 wherein a plurality of spaced perforations are provided.

15. The jar ticket of claim 14 wherein at least some of said plurality of perforations are oriented parallel to a longitudinal axis of said ticket body.

16. The jar ticket of claim 14 wherein at least some of said plurality of perforations are oriented perpendicular to a longitudinal axis of said ticket body.

17. The jar ticket of claim 14 wherein at least some of said plurality of perforations are oriented at an acute angle in relation to a longitudinal axis of said ticket body.

18. The jar ticket of claim 12 further comprising a second layer of adhesive disposed between said second panel of said wrapper body and an adjacent panel of said ticket body.

* * * * *